US005342746A

United States Patent [19]

Zengerle et al.

[11] Patent Number: 5,342,746

[45] Date of Patent: Aug. 30, 1994

[54] METHOD FOR THE FORMATION OF COLOR PHOTOGRAPHIC MATERIALS WITH HIGH COUPLING REACTIVITY AND REDUCED COLOR DEVELOPER PH SENSITIVITY

[75] Inventors: Paul L. Zengerle, Rochester; Richard K. Rothrock, Naples; Chris Johnson, Rochester, all of N.Y.

[73] Assignee: Eastman Kodak Company, Rochester, N.Y.

[21] Appl. No.: 975,249

[22] Filed: Feb. 5, 1993

Related U.S. Application Data

[63] Continuation-in-part of Ser. No. 816,020, Dec. 30, 1991, abandoned.

[51] Int. Cl.[5] ..... G03C 7/38; G03C 1/38

[52] U.S. Cl. ..... 430/546; 430/558; 430/638

[58] Field of Search ..... 430/449, 546, 627, 631, 430/638, 558; 252/363.5, 364

[56] References Cited

U.S. PATENT DOCUMENTS

| | | | |
|---|---|---|---|
| 3,788,857 | 1/1974 | Van Poucke et al. | 430/546 |
| 4,368,259 | 1/1983 | Nittel et al. | 430/546 |
| 4,419,441 | 12/1983 | Nittel et al. | 430/377 |
| 4,774,166 | 9/1988 | Sasaki et al. | 430/376 |
| 5,021,328 | 6/1991 | Takahashi | 430/502 |

FOREIGN PATENT DOCUMENTS

| | | | |
|---|---|---|---|
| 160789 | 8/1970 | Fed. Rep. of Germany | 430/546 |

OTHER PUBLICATIONS

Hackh's Chemical Dictionary, pp. 25, 27 (1984).

*Primary Examiner*—Lee C. Wright
*Attorney, Agent, or Firm*—Edith A. Rice

[57] ABSTRACT

A silver halide light-sensitive photographic element comprising a support and provided thereon a plurality of light-sensitive layers including a green-sensitive layer comprising a dispersion of particles in a hydrophilic colloid, the particles comprising a pyrazolazole dye forming coupler dissolved in a coupler solvent comprising a long chain unsaturated alcohol.

15 Claims, 1 Drawing Sheet

METHOD FOR THE FORMATION OF COLOR PHOTOGRAPHIC MATERIALS WITH HIGH COUPLING REACTIVITY AND REDUCED COLOR DEVELOPER PH SENSITIVITY this application is a continuation-in-part of copending U.S. patent application Ser. No. 816,020 filed Dec. 30, 1991, abandoned, the disclosure of which is incorporated herein by reference.

FIELD OF THE INVENTION

The present invention relates to multilayer color photographic light-sensitive materials which can provide color images, and in particular to using coupler solvents for color couplers which increase coupler reactivity and provide reduced sensitivity to color developer pH variability.

BACKGROUND OF THE INVENTION

Silver halide color photographic materials typically have a multi-layer constitutional light-sensitive film, coated on a support, comprising three kinds of silver halide emulsion layers selectively sensitized so that the layers have light-sensitivity usually to blue-light, green-light, and red-light respectively.

For the formation of color photographic images, photographic couplers for the three colors of yellow, magenta, and cyan are incorporated in the light-sensitive layers. The photographic materials, after having been exposed to light, are subjected to color development with a so-called color developer. The coupling reaction between the oxidation product of an aromatic primary amine and the coupler results in the formation of colored dyes. The coupling reaction rate is preferably as high as possible, and the couplers are preferred to have a high colorability so as to obtain a higher color density within the limited development time.

In addition, the yellow, magenta, and cyan couplers are required to be fixed individually to the respective silver halide emulsion layers each having a selective sensitivity to blue, green, or red light, respectively, to prevent color stain. Therefore, the couplers to be used in practice are to have a long-chain aliphatic group in the molecule as a diffusion-resistant group.

In practical use of such couplers having a hydrophobic diffusion resistant group, it is known to dissolve these substances in a high boiling solvent (oil-former) and a low boiling or partially water soluble auxiliary solvent and then to disperse this solution in an aqueous medium usually containing a hydrophillic binder, such as gelatin, and surfactant. After removal of the low boiling auxiliary solvent the hydrophobic substance is present in the aqueous medium in the form of small particles or droplets of oil-former containing the hydrophobic substance. The process was first described in U.S. Pat. No. 2,322,027.

This method of dispersing hydrophobic substances has persisted substantially in this form to the present day, although various other types of substances have been proposed for use as oil-formers. Examples of useful oil-formers or coupler solvents are described by, for instance, Jelley et al U.S. Pat. No. 2,322,027, Sawdey et al U.S. Pat. No. 2,533,514, Fierke et al U.S. Pat. No. 2,801,171, Smith U.S. Pat. No. 3,748,141 and Krishnamurthy U.S. Pat. Nos. 4,540,657 and 4,684,606.

It is desirable that the color photographic materials described heretofore deliver consistent color images throughout the processing of large volumes of these materials through the various processing solutions. Hence, it is required that the color photographic materials have a low sensitivity to variations in the composition and pH of these solutions which inevitably occur in the trade due to the processing of large quantities of material. Since the color images are formed in the color developer solution, the variability of its composition and pH are most important with regard to delivering high quality color images consistently.

The selection of color dye-forming coupler used can have a marked effect on the color reproducibility of the light-sensitive material. Methods of improving color reproducibility by use of megenta couplers which form dyes having little or no secondary absorptions are disclosed in the art including U.S. Pat. No. 3,725,067 and Japanese Patent Open to Public Inspection Nos. 42045/1983, 171956/1984, 43659/1985 and 190779/1985. The pyrazoloazole magenta couplers significantly improve color reproducibility. However, a major problem with these couplers is that the density of the dye image formed exhibits high variability when processing conditions change, in particular the pH of the color developer. This problem has been described in European Patent Application No. 0422595A1 which teaches the use of compounds having a hydroxyl group and an ester group used in combination with pyrazoloazole magenta couplers.

In the present invention, it has been found that this sensitivity to developer pH can be greatly reduced by the use of pyrazoloazole magenta couplers in combination with a long chain unsaturated alcohol. It has also been found that this combination produced unexpected increases in coupling reactivity.

SUMMARY OF THE INVENTION

The primary object of the invention is to provide a silver halide color photographic material having improved processing stability.

The secondary object of the invention is to provide a light-sensitive material capable of providing a dye image with a color density which is insensitive to variations in processing conditions, in particular, to variations in the pH of the color developer.

A third object of the invention is to provide a light-sensitive material containing dye forming couplers with high coupling reactivity.

The above objects can be attained by a silver halide light-sensitive material comprising a support and provided theron a plurality of light-sensitive layers including at least one greensensitive layer, wherein the at least one greensensitive layer contains a magenta coupler represented by Formula M-I:

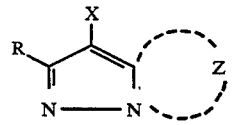

Formula M-I where Z represents the group of non-metallic atoms for forming a nitrogen containing heterocyclic ring, X represents a hydrogen atom or a substituent capable of splitting off by a reaction with an oxidization product of a developer; and R represents a hydrogen atom or a substituent; and a compound represented by Formula S-I:

R'—OH Formula S-I where R' represents an aliphatic hydrocarbyl group containing between 8 and 32 carbon atoms and at least one double-bond linking adjacent aliphatic carbon atoms. The aliphalic group may be either straight-chain or branched with either cis- or trans-isomeric configuration.

DETAILED DESCRIPTION OF THE INVENTION

Figure 1:
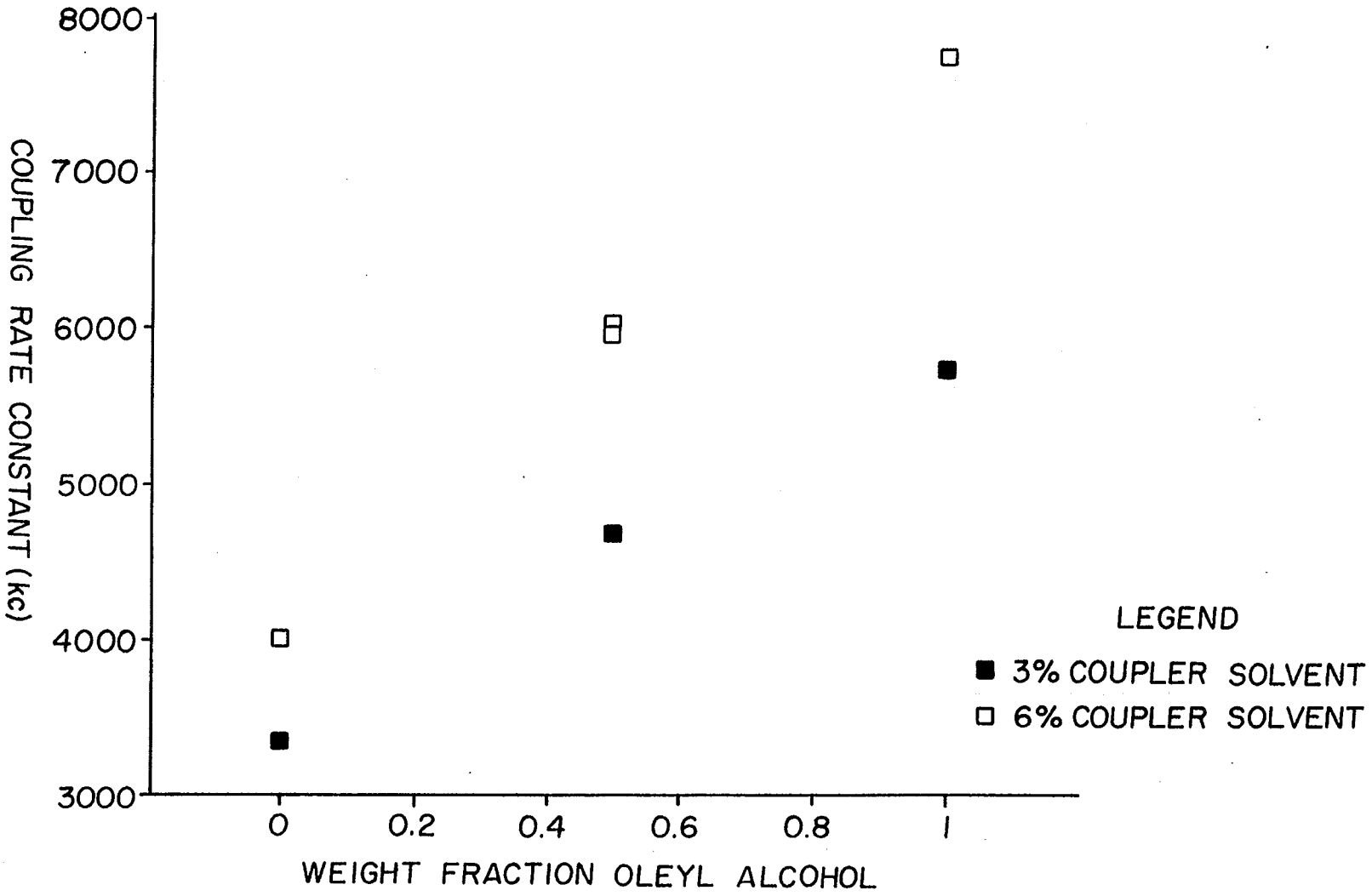
FIG. 1 is a graph showing the effect of oleyl alcohol on magenta coupler dispersion reactivity.

In Formula M-I, the examples of the substituent represented by R are an alkyl group, an aryl group, and anilino group, an acylamino group, a sulfonamide group, an alkylthio group, an arylthio group, an alkenyl group, a cycloalkyl group, a halogen atom, a cycloalkenyl group, an alkynyl group, a heterocyclic group, a sulfonyl group, a sulfinyl group, a phosphonyl group, an acyl group, a carbamoyl group, a sulfamoyl group, a cyano group, an alkoxy group, an aryloxy group, a heterocyclicoxy group, a siloxy group, an acyloxy group, a carbamoyloxy group, an amino group, an alkylamino group, an imido group, an ureido group, a sulfamoylamino group, an alkoxycarbonylamino group, an aryloxycarbonylamino group, an alkoxycarbonyl group, an aryloxycarbonyl group, a heterocyclicthio group, a spiro compound residue and a bridged hydrocarbon residue.

The respective groups represented by R are as follows: the alkyl group has preferably 1 to 32 carbon atoms and may be linear or branched; the aryl group is preferably phenyl; the examples of the acylamino group are alkylcarbonylamino and arylcarbonylamino; the examples of the sulfonamide group are alkylsufonylamino and arylsulfonylamino; the alkyl and aryl components in the alkylthio and arylthio groups may be the same as the above alkyl and aryl groups; the alkenyl group has preferably 2 to 32 carbon atoms and may be linear or branched; the cycloalkyl and cycloalkenyl groups each have preferably 3 to 12, more preferably 5 o 7 carbon atoms; the examples of the sulfonyl group are alkylsulfonyl and arylsulfonyl; the examples of the sulfinyl group are alkylsulfinyl and arylsulfinyl; the examples of the phosphonyl group are alkylphosphonyl, alkoxyphosphonyl, arloxyphosphonyl and arylphosphonyl; the examples of the acyl group are alkylcarbonyl and arylcarbonyl; the examples of the carbamoyl group are alkylcarbamoyl and arylcarbamoyl; the examples of the sulfamoyl group are alkylsulfamoyl and arylsulfamoyl; the examples of the acyloxy group are alkylcarbonyloxy and arylcarbonyloxy; the examples of the carbamoyloxy are alkylcarbamoyloxy and arylcarbamoyloxy; the examples of the ureido group are alkylureido and arylureido; the examples of the sulfamoylamino group are alkylsulfamoylamino and arylsulfamoylamino; the heterocyclic group is preferably a 5 to 7-membered ring such as 2-furyl, 2-thienyl, 2-pyrimidyl and 2benzothiazolyl; the heterocyclicoxy group is preferably a 5 to 7-membered ring such as 3,4,5,6-tetrahydropyranyl-2-oxy and 1-phenyltetrazole-5-oxy; the heterocyclicthio group is preferably a 5 to 7membered ring such as 2-pyridylthio, 2benzothiazolylthio and 2,4-diphenoxy-l,3,5-triazole6-thio; the examples of the siloxy group are trimethylsiloxy, triethylsiloxy and dimethylbutylsiloxy; the examples of the imido group are succinic imido, 3-heptadecyl succinic imido, phthalimido and glutarimido; the spiro compound residue includes a spiro [3.3]heptane-1-yl; the examples of the bridged hydrocarbon compound residue are bicyclo [2.2.1]heptane-1-yl, tricyclo [3.3.1.1.3.7] decane-1-yl and 7,7-dimethyl-bicyclo [2.2.1] heptane-1-yl.

The examples of the group represented by X are a halogen atom, an alkoxy group, an aryloxy group, a heterocyclicoxy group, an acyloxy group, asulfonyloxy group, an alkoxycarbonyloxy group, an aryloxycarbonyloxy group, an alkyloxalyloxy group, an alkoxyoxalyoxy group, an alkylthio group, an arylthio group, a heterocyclicthio group, an alkoxythiocarbonylthio group, an acylamino group, a sulfonamide group, a nitrogen-containing heterocycle having a bonding site at the nitrogen atom, an alkoxycarbonylamino group, an aryloxycarbonylamino group, a carboxyl group.

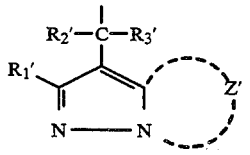

wherein $R_1'$ and Z' are the same groups as those defined for R and Z in Formula M-I, respectively, and $R_2'$ and $R_3'$ each represent a hydrogen atom, an aryl group, an alkyl group and a heterocyclic group. Of them, a halogen atom, in particular chlorine is preferable.

The nitrogen-containing heterocycles formed by Z and Z' are a pyrazole ring, an imidazole ring, a triazole ring and a tetrazole ring, and may have the same substituents as those defined for R.

The magenta coupler represented by M-I are represented by the following Formulas M-II to M-VII:

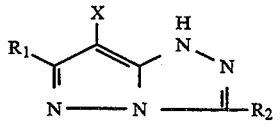

Formula M-II

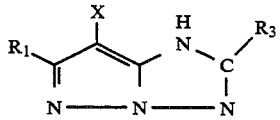

Formula M-III

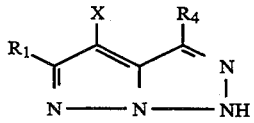

Formula M-IV

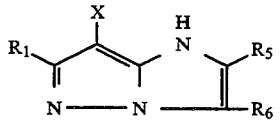

Formula M-V

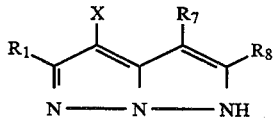

Formula M-VI

-continued

Formula M-VII

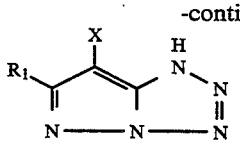

wherein $R_1$ to $R_4$ and X represent the same groups as those defined for R and X in Formula M-I, respectively.

The magenta coupler represented by Formula M-I is represented preferably by the following Formula M-VIII:

Formula M-VIII

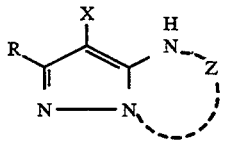

wherein $R_1$, X and $Z_1$ represent the same groups as those defined for R, X and Z in Formula M-I, respectively.

Of the magenta couplers represented by Formula M-II to M-VII, preferable are those represented by Formula M-II.

When the light-sensitive material is used for forming a positive image, R and $R_1$ are preferably in formula's M-I through M-VIII by

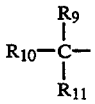

wherein $R_9$, $R_{10}$, and $R_{11}$ each represent the same groups as those defined for $R_1$ provided that two of $R_9$, $R_{10}$, and $R_{11}$ may combine to form a saturated or unsaturated ring such as cycloalkane, cycloalkene and heterocycle and that $R_9$ or $R_{11}$ may combine with this ring to form a bridged hydrocarbon residue.

Of the substituents represented preferable at least two of $R_9$ to $R_{11}$ are alkyl groups, or at least one of $R_9$ to $R_{11}$ is a hydrogen atom and the remaining two combine to form a cycloalkyl group.

In the former case, it is more preferable is that two of $R_9$ to $R_{11}$ are alkyl groups and the remaining one is either a hydrogen atom or an alkyl group.

When the light-sensitive material is used for forming a negative image. R and $R_1$ of Formulas M-I through M-VIII are preferably $R_{12}$ —$CH_2$13 wherein $R_{12}$ is the same group as that defined for R. $R_{12}$ is preferably is preferably a hydrogen atom or an alkyl group.

The examples of the above magenta couplers are given below:

M-1

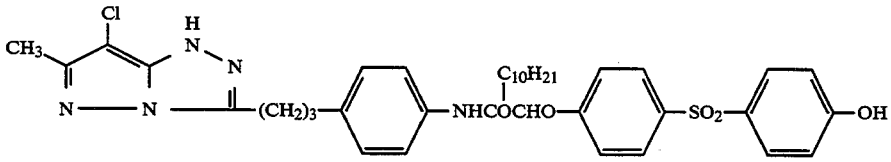

M-2

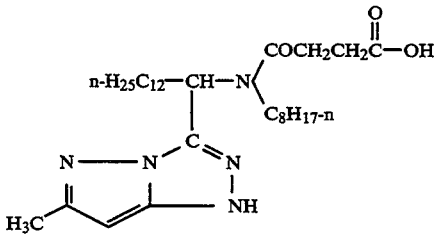

M-3

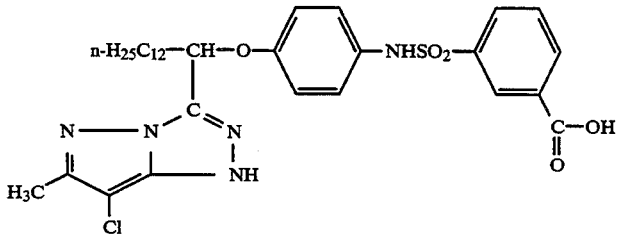

-continued
M-4
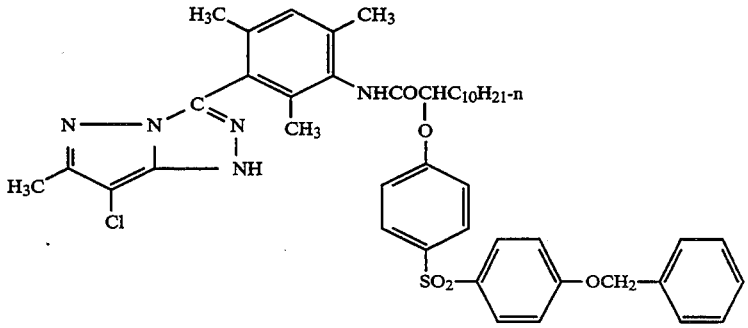
M-5
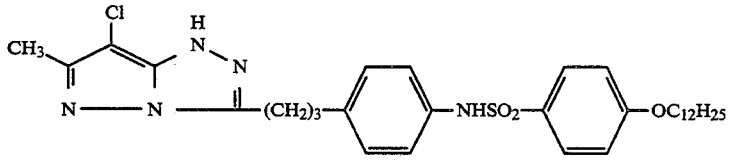
M-6
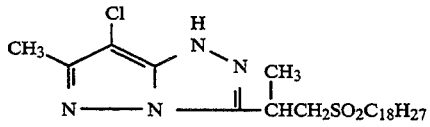
M-7
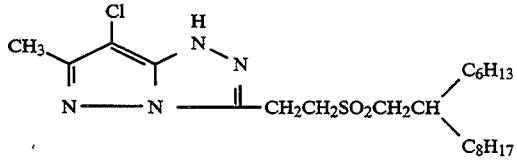
M-8
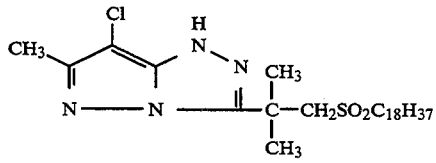
M-9
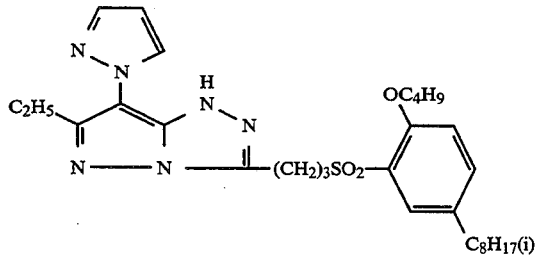
M-10
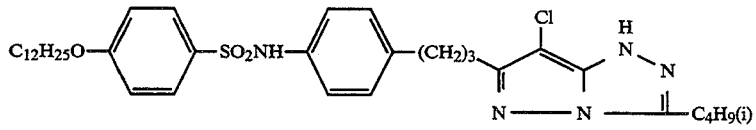
M-11
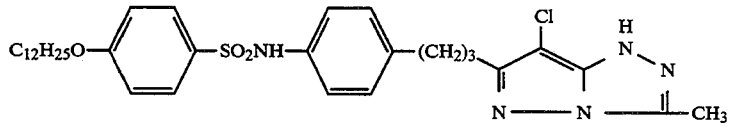
M-12
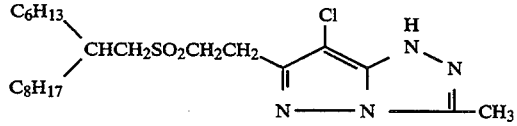

-continued
M-13
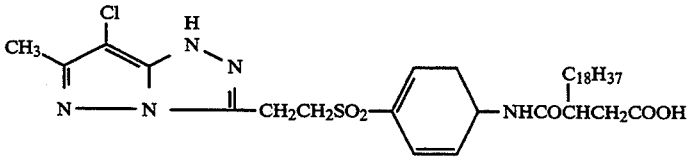
M-14
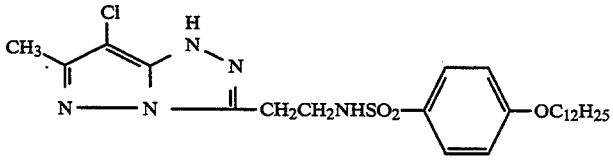
M-15
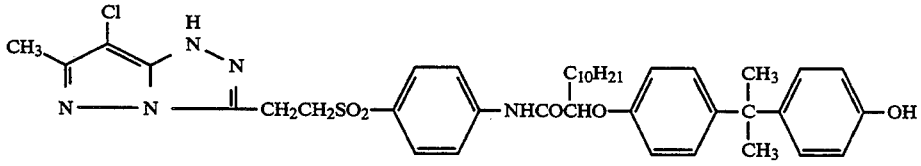
M-16
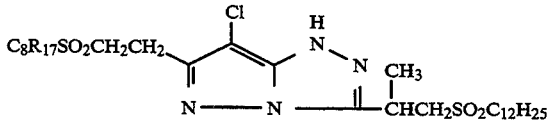
M-17
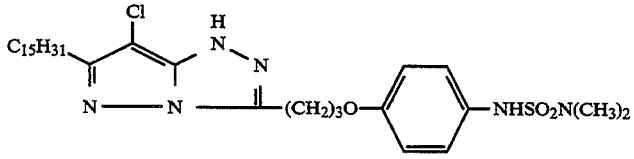
M-18
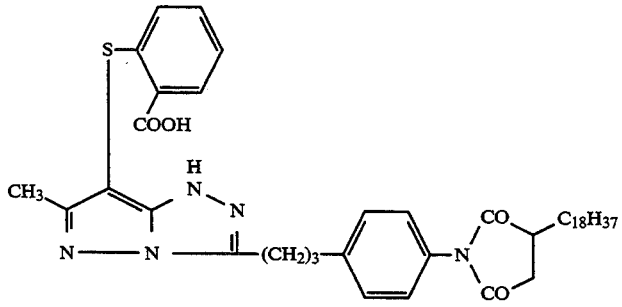
M-19
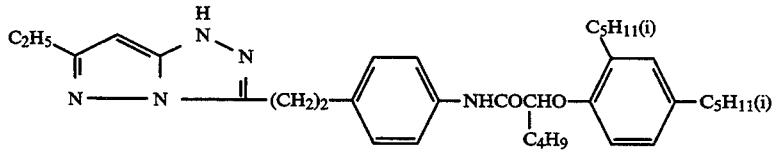
M-20
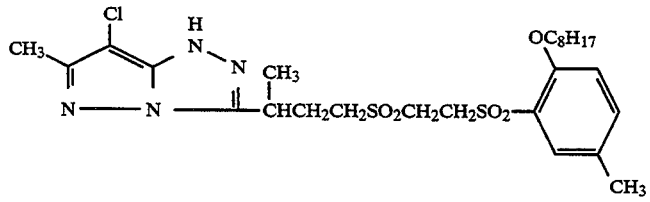
M-21
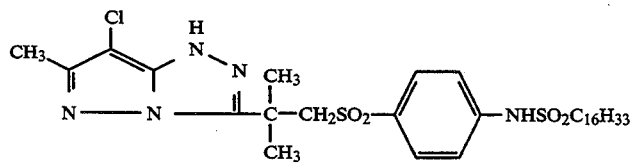

-continued
M-22
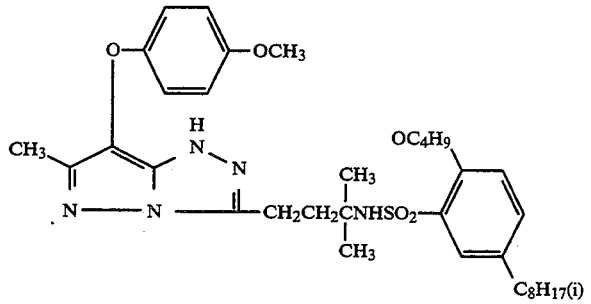
M-23
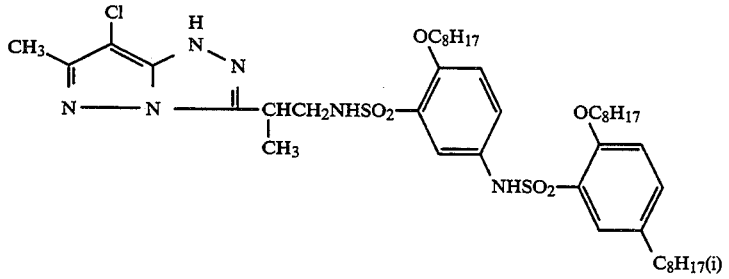
M-24
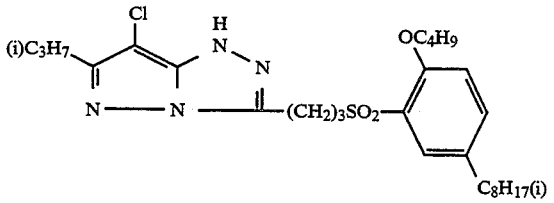
M-25
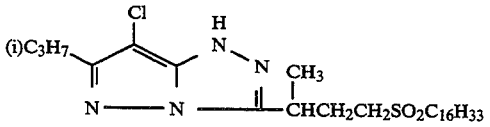
M-26
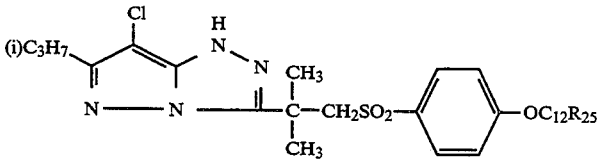
M-27
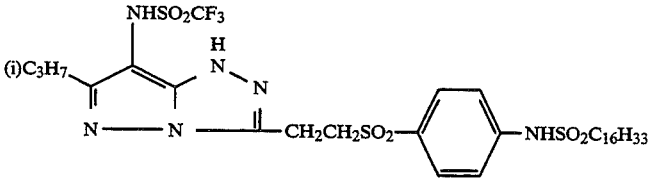
M-28
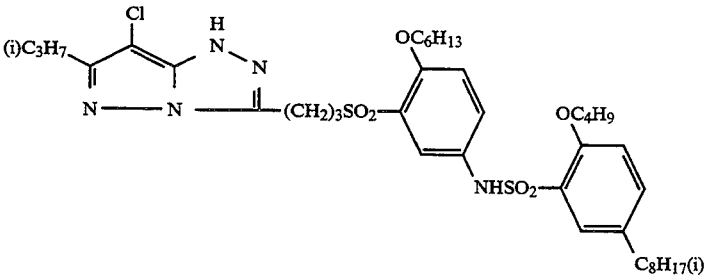

-continued
M-29
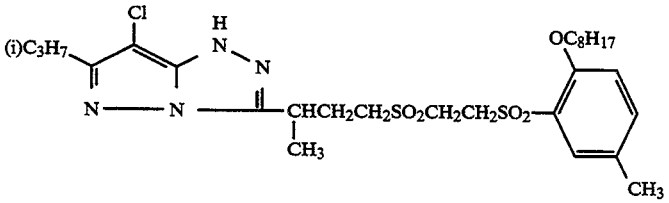
M-30
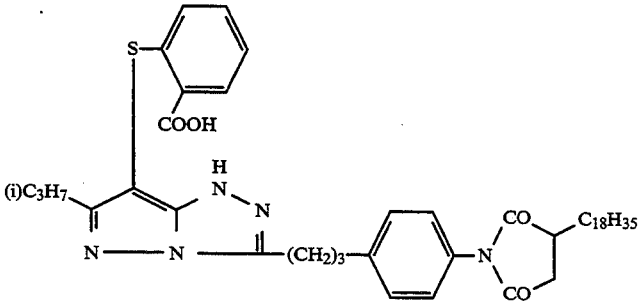
M-31
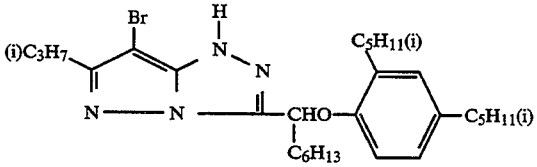
M-32
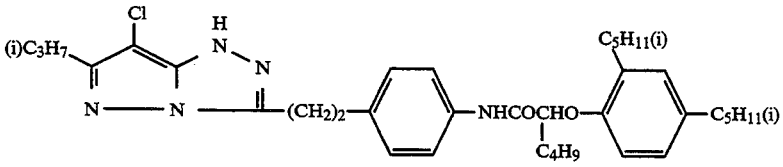
M-33
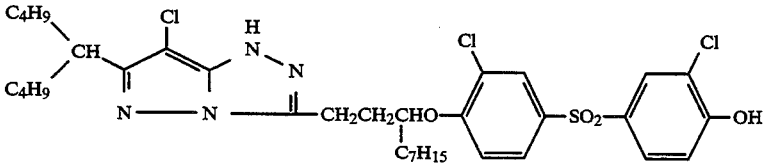
M-34
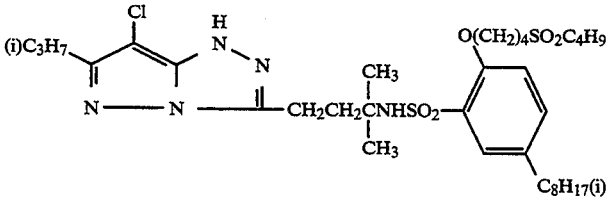
M-35
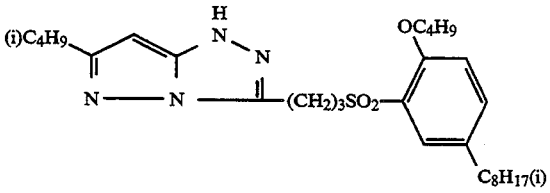
M-36
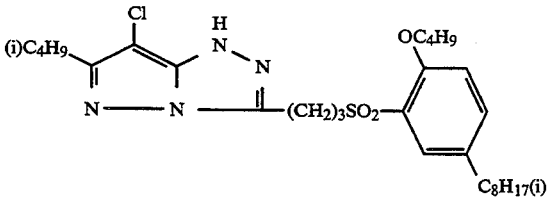

-continued
M-37
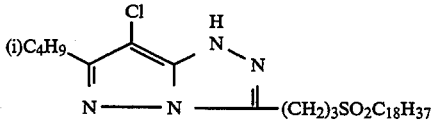
M-38
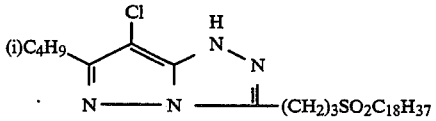
M-39
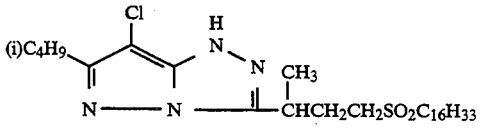
M-40
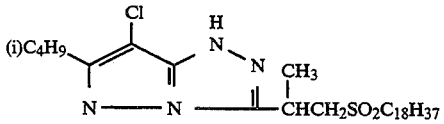
M-41
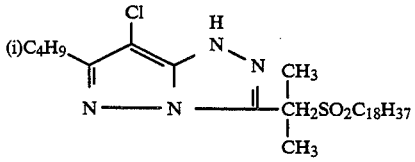
M-42
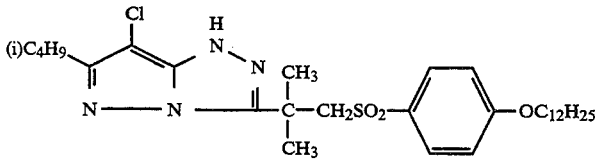
M-43
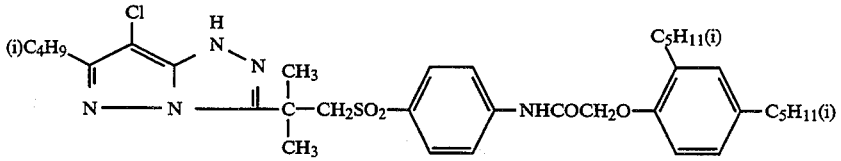
M-44
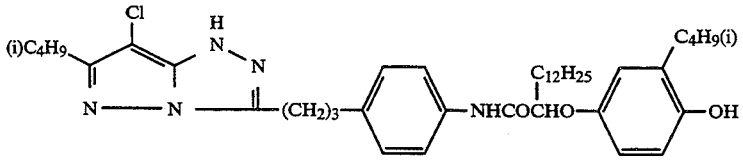
M-45
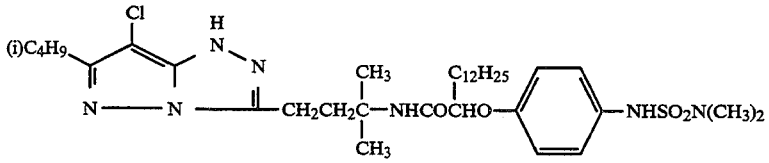
M-46
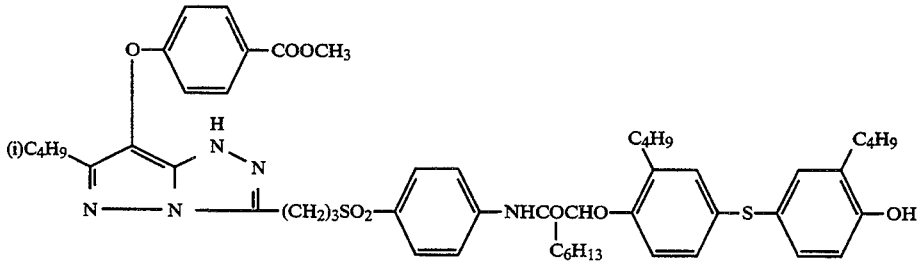

-continued
M-47
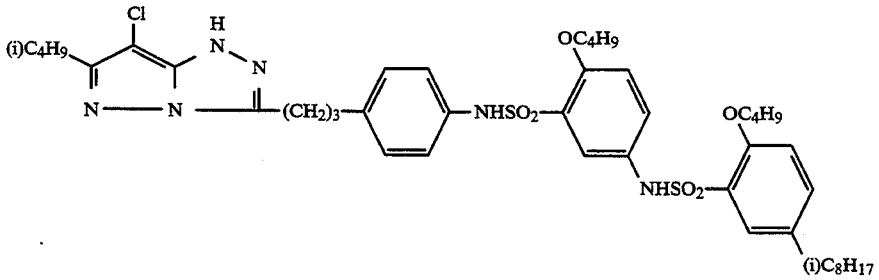
M-48
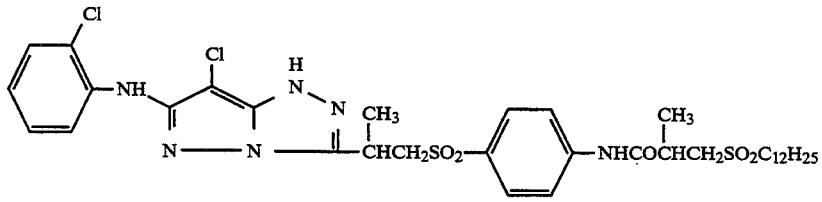
M-49
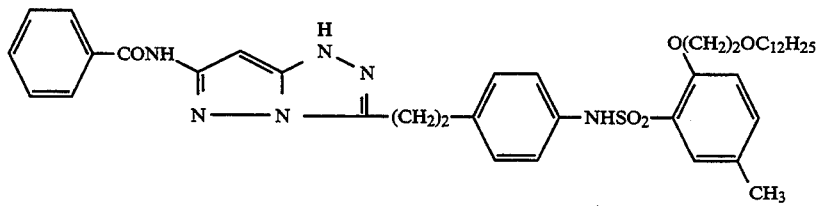
M-50
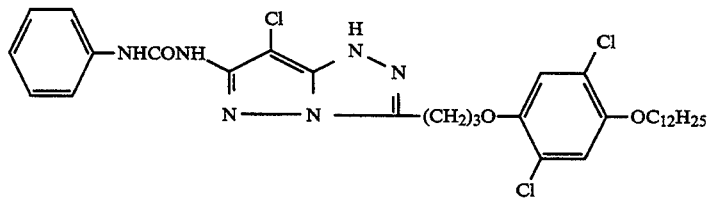
M-51
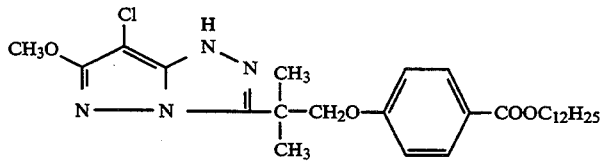
M-52
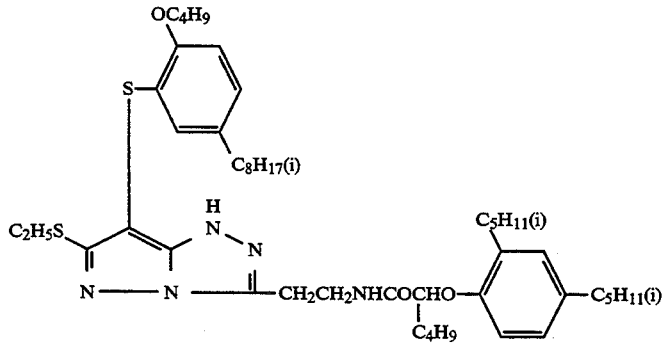
M-53
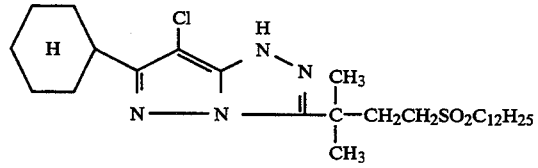

-continued
M-54
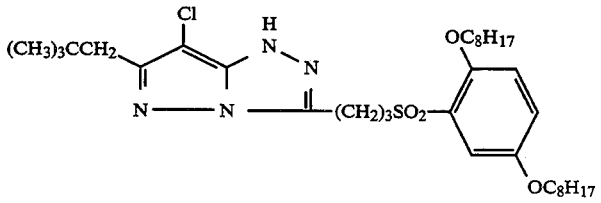
M-55
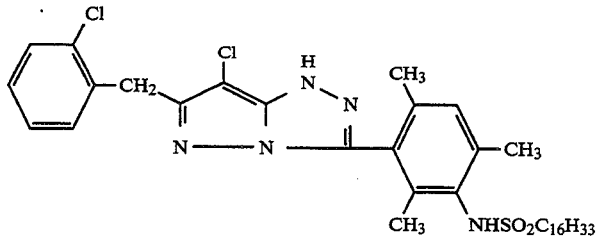
M-56
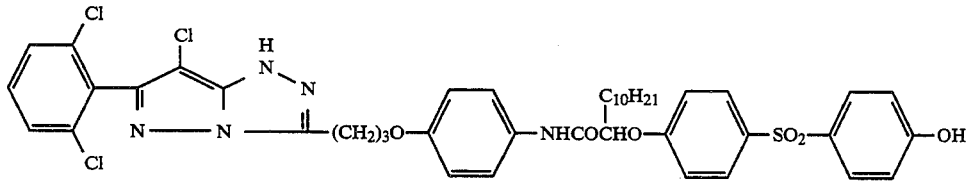
M-57
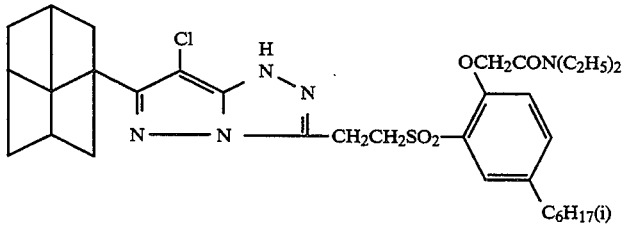
M-58
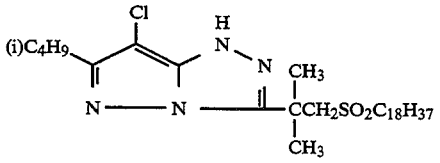
M-59
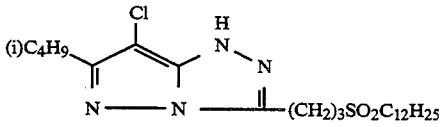
M-60
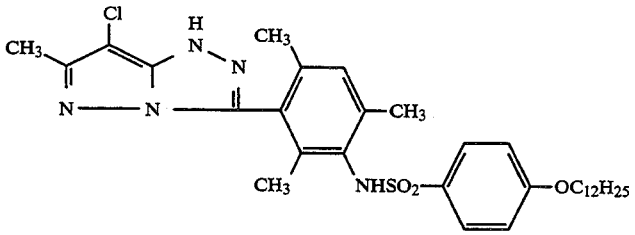
M-61
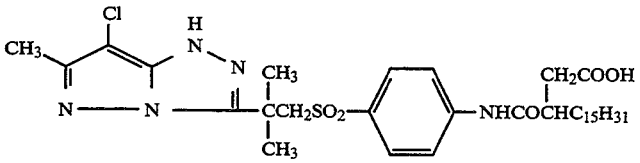

-continued
M-62
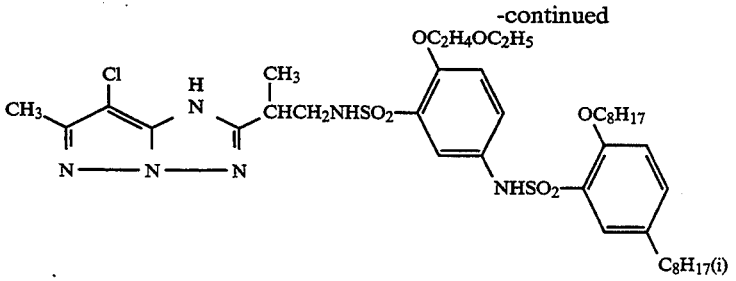
M-63
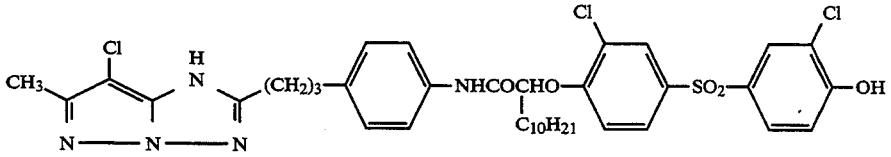
M-64
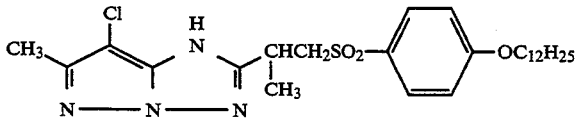
M-65
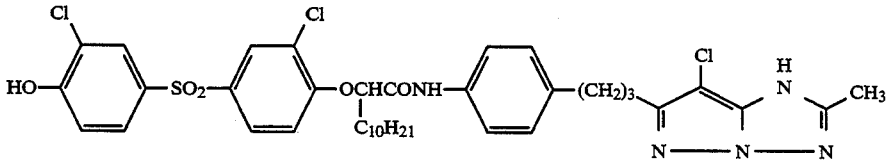
M-66
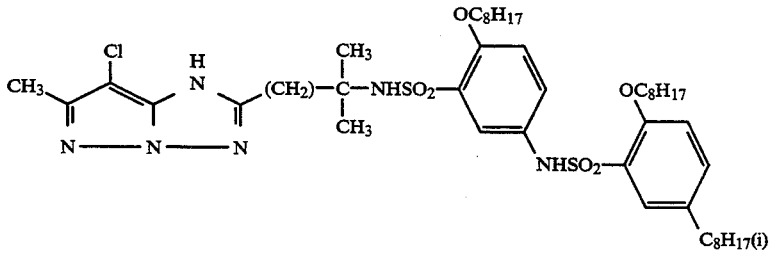
M-67
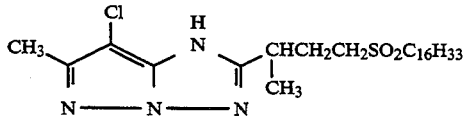
M-68
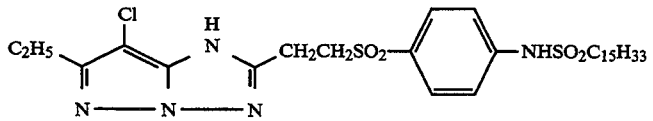
M-69
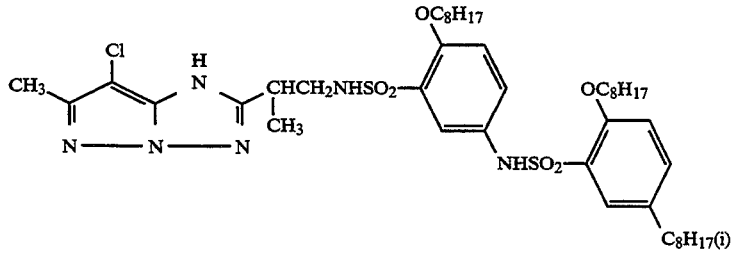
M-70
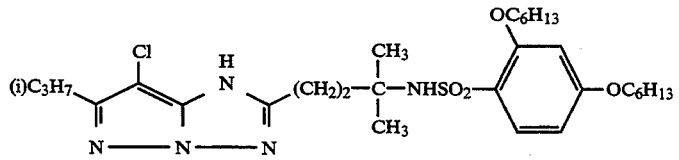

-continued
M-71
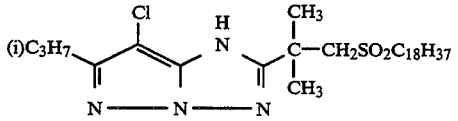
M-72
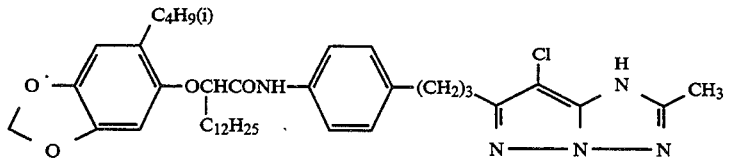
M-73
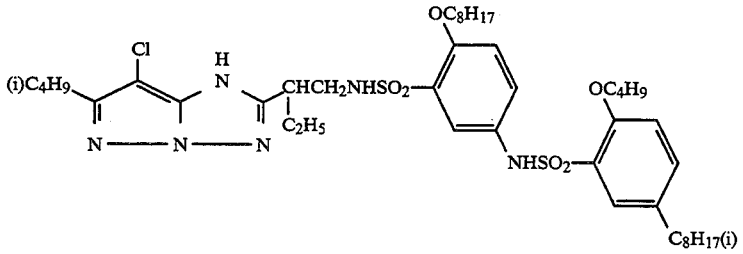
M-74
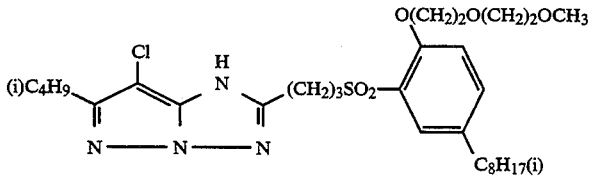
M-75
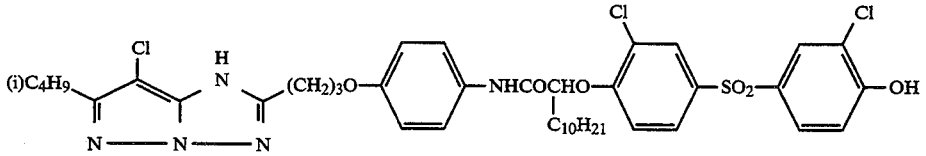
M-76
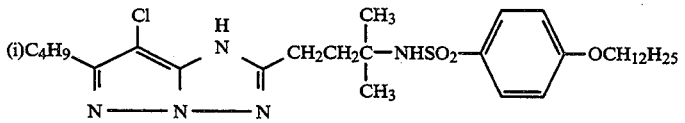
M-77
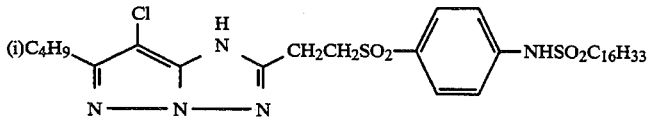
M-78
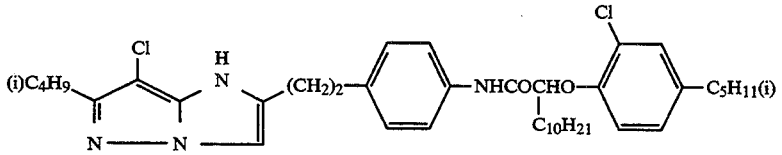
M-79
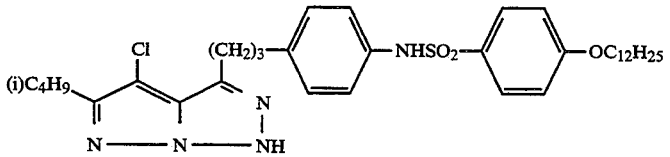

-continued

M-80

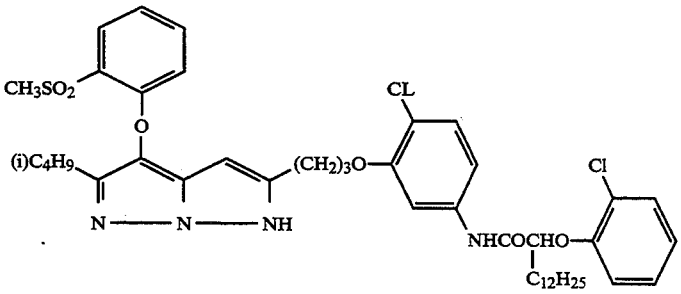

M-81

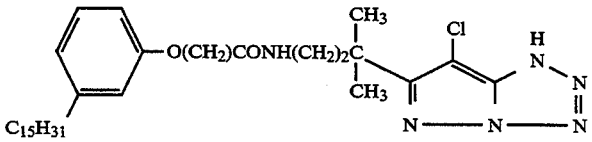

M-82

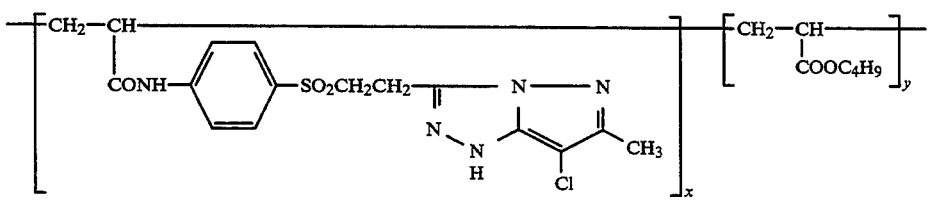

x:y = −50:50

M-83

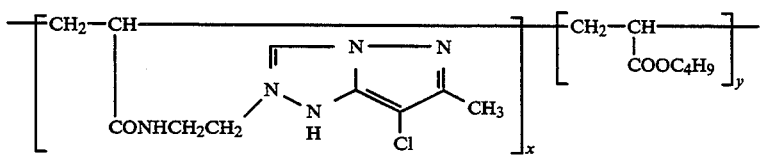

x:y = −50:50

M-84

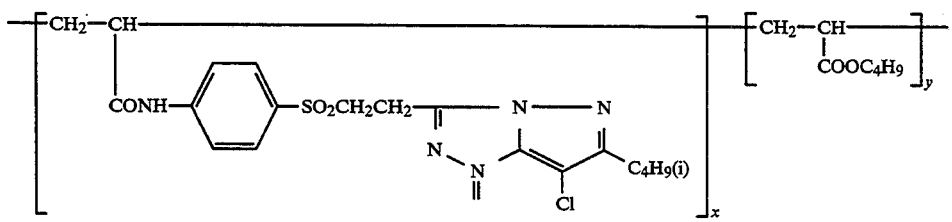

x:y = −50:50

M-85

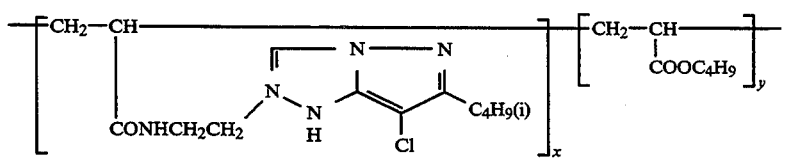

x:y = −50:50

The other examples of the magenta couplers usable in the invention are described in Japanese Patent Application No. 9791/1988.

The preceding magenta couplers can be synthesized by the methods described in Journal of the Chemical Society, Perkin I (1977), pp. 2047 to 2052, U.S. Pat. No. 3,725,067, Japanese Patent O.P.I. Publication No. 99437/1984, 42045/1983, 162548/1984, 171956/1984, 33552/1985, 43659/1985, 172982/1985 and 190779/1985.

The preceding magenta couplers are added normally in an amount of $1\times10^{-3}$ to 1 mol, preferably $1\times10^{-2}$ to $8\times10^{31\ 1}$ mol per mol of silver halide, and may be used in combination with other couplers.

Next, the compound represented by Formula S-I is explained below.

The aliphatic group represented by R′ consists of 8 to 32 carbon atoms and at least one double-bond and may be either straight-chain or branched with either cis—or trans—isomeric configuration. The term "aliphatic group" means an open chain hydrocarbon group free of aromatic substituents.

Examples of compounds represented by Formula S-I are given below:

$CH_3(CH_2)_7CH{=}CH(CH_2)_7OH$ S-1

$CH_3(CH_2)_{11}CH(OH){-}CH{=}CH_2$ S-2

$CH_3{=}CH(CH_2)_{12}CH_2OH$ S-3
$CH_3CH{=}CH(CH_2)_{11}CH_2OH$ S-4
$CH_3(CH_2)_5CH{=}CH(CH_2)_3CH_2OH$ S-5
$CH_3(CH_2)_3CH{=}CH(CH_2)_5CH_2OH$ S-6
$CH_3(CH_2)_2CH{=}CH(CH_2)_6CH_2OH$ S-7
$CH_3(CH_2)_3CH{=}CH(CH_2)_2CH{=}CH(CH_2)_5CH_2OH$ S-8
$CH_3(CH_2)_2CH{=}CHCH{=}CH(CH_2)_8CH_2OH$ S-9
$CH_3(CH_2)_7CH{=}CH(CH_2)_3CH_2OH$ S-10
$CH_3(CH_2)_3CH{=}CH(CH_2)_7CH_2OH$ S-11
$CH_3CH_2CH{=}CH(CH_2)_9CH_2OH$ S-12
$CH_3CH{=}CHCH_2CH{=}CH(CH_2)_7CH_2OH$ S-13

$(CH_3)_2C{=}CHCH_2CH_2C(CH_3){=}CHCH_2OH$ S-14

$CH_2CH_2CH(CH_3)CH_2CH_2CH_2CH(CH_3)_2$
$CH_2CH(CH_3)CH_2CH_2CH_2C(CH_3){=}CHCH_2OH$ S-15

In the invention, the magenta coupler represented by Formula M-I (called magenta coupler M-I) and the coupler solvent represented by Formula S-I (called coupler solvent S-I) are incorporated into at least one of the green-sensitive layers.

Magenta coupler M-I and coupler solvent S-I can be added by a known method; Magenta coupler M-I is dissolved in coupler solvent S-I and an auxiliary solvent such as ethyl acetate, butyl acetate or 2- (2-butoxyethoxy) ethyl acetate, with or without an additional coupler solvent such as dibutyl phthalate or tricresyl phosphate. The solution is then dispersed in an aqueous gelatin solution containing a surfactant with a high-speed rotary mixer, a colloid mill, a homogenizer or an ultrasonic apparatus; followed by removal of the auxiliary solvent by evaporation, washing, or dialysis methods.

The final dispersion is then added to a silver halide emulsion.

The amount of coupler solvent is preferably 0.01 to 10.0 g, more preferably 0.1 to 4.0 g per gram of magenta coupler M-I. Coupler solvent S-I may be employed alone as the only permanent solvent or in combination with other permanent solvents.

The silver halide emulsions used in the invention may be conventional or new emulsions and may have cubic, octahedral or tabular grains. The silver halide emulsions can be chemically sensitized by conventional methods, and can be spectrally sensitized to a prescribed wavelength region with a sensitizing dye. The silver halide emulsions may contain additives such as antifoggant or stabilizers. Gelatin is preferably used as a binder.

The emulsion layers and other hydrophillic colloidal layers may be hardened.

Also usable are colored couplers, competitive couplers and compounds which release by a coupling reaction with an oxidation product of a developing agent photographically useful groups such as: a development accelerator, a bleaching accelerator, a developing agent, a silver halide solvent, a toning agent, a hardener, a fogging agent, an antifoggant, a chemical sensitizer and a desensitizer.

There may be provided auxiliary layers such as a filter layer, ultraviolet absorbing layer, and an anti-halation layer. These layers and/or the emulsion layers may contain a dye which can be removed from the light-sensitive material or bleaching during processing.

The light-sensitive material may contain a formalin scavenger, an oxidized developer scavenger, a bleaching agent, a matting agent, a lubricant, an image stabilizer, a surfactant, an anti-fogging agent, a development accelerator, a development retarder and a bleaching accelerator.

Examples of the support that may be used are polyethylene-laminated paper, a polyethylene terephthalate film, baryta paper, and a cellulose triacetate film.

A dye image can be obtained by processing an exposed light-sensitive material by conventional methods.

EXAMPLE 1

A magenta coupler dispersion was prepared in the following manner:

80.0 g of 50% Type IV gelatin and 30.0 g of a 10% solution of Alkanol-XC (Dupont) was dissolved in 270.0 g of distilled water at 50 C. 30.0 g of Compound M-1 was dissolved in 15.0 g of tricresylphosphate and 60.0 g of 2-(2-butoxyethoxy) ethyl acetate at 125 C., then added to the aqueous gelatin/surfactant solution. The resulting mixture was stirred with a glass rod and passed through a Gaulin colloid mill 5 times. The dispersion is then chill set, noodled and washed for 8 hours to remove the auxiliary coupler solvent 2-(2-butoxyethoxy) ethyl acetate. The dispersion is then remelted, stirred, and chill set. This dispersion is referred to as Dispersion A. Dispersion B was prepared as above except that tricresylphosphate was replaced by 7.5 g of oleyl alcohol and 7.5 g of tricresylphosphate. Dispersion C was prepared as above except that tricresylphosphate was replaced by 15.0 g of oleyl alcohol. Dispersion D was prepared as above except that 30.0 g of tricresylphosphate was used in the oil phase and 255.0 g of distilled water was used in the aqueous phase. Dispersion E was prepared as Dispersion D except that tricresylphosphate was replaced by 15.0 g of oleyl alcohol and 15.0 g of tricresylphosphate- Dispersion F was prepared as Dispersion D except that tricresylphosphate was replaced with 30.0g of oleyl alcohol.

The effect of variations of both total coupler solvent level and the weight fraction of oleyl alcohol on coupler reactivity is illustrated by results shown in FIG. 1. Coupling rate constants (kc) in $dm^3\,m^{-1}\,s^{-1}$ were measured using an aqueous competition test with sulfite ion. The results demonstrate that coupler reactivity is substantially increased as the weight fraction of oleyl alcohol increased at both total coupler solvent levels.

EXAMPLE 2

A magenta coupler dispersion was prepared in the following manner:

40.0 g of coupler M-2 was dissolved in 40.0 g of permanent solvent (tricresylphosphate or oleyl alcohol) and 60.0 g of ethyl acetate at 60° C. This was added to an aqueous phase consisting of 80.0 g of 50% Type IV gelatin, 20.0 g of a 10% solution of Alkanol-XC (Dupont) and 300.0 g of distilled water. The resulting mixture was stirred with a glass rod and passed through a Gaulin colloid mill 5 times. The ethyl acetate was removed using a rotary evaporator for 15 minutes at 60° C.

These dispersions were then coated in the fast and slow green-sensitive records of the multilayer color film package described below in Table I.

TABLE I

| Layer | Main Composition | Amount |
|---|---|---|
| UV Absorber Layer | Gelatin | 1.23 g/m$^2$ |
| | UV-1 | 0.11 |
| | UV-2 | 0.11 |
| | AgBr Emulsion 0.06 um | 0.22 |
| Fast Blue-Sensitive Layer | Gelatin | 0.80 |
| | Y-1 | 0.19 |
| | Y-2 | 0.05 |
| | AgBrI Emulsion (3% I) 2.0 um | 0.65 |
| Slow Blue-Sensitive Layer | Gelatin | 1.65 |
| | Y-2 | 0.05 |
| | Y-3 | 0.86 |
| | AgBrI Emulsion (3% I) 1.0 um | 0.24 |
| | AgBrI Emulsion (3% I) 0.4 um | 0.27 |
| Yellow Filter Layer | Gelatin | 0.086 |
| | Carey-Lea Silver | 0.04 |
| | I-1 | 0.05 |
| Fast Green-Sensitive Layer | Gelatin | 1.24 |
| | M-2 | 0.14 |
| | M-3 | 0.03 |
| | AgBrI Emulsion (3% I) 1.2 um | 0.97 |
| Slow Green-Sensitive Layer | Gelatin | 1.90 |
| | M-2 | 0.14 |
| | M-4 | 0.03 |
| | AgBrI Emulsion (3% I) 1.2 um | 0.22 |
| | AgBrI Emulsion (3% I) 0.95 um | 0.54 |
| | AgBrI Emulsion (1.5% I) 0.45 um | 0.54 |
| Interlayer | Gelatin | 1.29 |
| | I-1 | 0.05 |
| Fast Red-Sensitive Layer | Gelatin | 1.29 |
| | C-1 | 0.20 |
| | C-2 | 0.09 |
| | C-3 | 0.03 |
| | AgBrI Emulsion (6% I) 1.2 um | 0.97 |
| Slow Red-Sensitive Layer | Gelatin | 2.51 |
| | C-1 | 1.01 |
| | C-2 | 0.11 |
| | C-4 | 0.01 |
| | AgBrI Emulsion (6% I) 1.0 um | 1.42 |
| | AgBrI Emulsion (1% I) 0.36 um | 0.93 |
| Anti-halation Layer | Gelatin | 2.69 |
| | Filamentary Ag$^o$ | 0.32 |

These film samples were given a gradation exposure with a sensitometer using a 3000K color temperature light source through a 21 step 0–4 tablet and a Wratten C-7 filter for 1/25 sec.

Afterward, the samples were subjected to a C-41 process in which the concentration of CD-4 and sodium bromide in the developer solution and the developer pH were varied using a $2^3$ factorial design with two center point replicates. The levels were selected as follows:

| Variable | Low | Center | High |
|---|---|---|---|
| CD-4 | 3.5 | 4.5 | 5.5 |
| Na Br | 0.9 | 1.4 | 1.9 |
| pH | 9.9 | 10.0 | 10.1 |

The slopes of the Density versus log exposure curves (green gammas) were determined using standard Status M densitometry. From these gamma values, parameter estimates for each dependent variable were calculated using multiple linear regression analysis. A high value for the estimate indicates a greater sensitivity of the response (green gamma) to a given dependent variable, such as developer pH. The sensitivity values are reported as change in green gamma per developer pH unit as calculated from the regression coefficients. Results are summarized in Table II.

TABLE II

| Effect of Permanent Solvent on a Developer pH Sensitivity | |
|---|---|
| Coupler Solvent | Change in Gamma per pH Unit |
| Tricresylphosphate (Prior Art) | 0.71 |
| Tricresylphosphate | 0.72 |
| Oleyl alcohol (Present Invention) | 0.54 |

Surprisingly, the results show that the film is less sensitive to changes in the color developer pH when the permanent solvent of the present invention is used with magenta coupler M-2.

EXAMPLE 3

Another set of magenta coupler dispersions were prepared and coated in the multilayer film package described in Example 2. They were also subjected to the same exposure and processing conditions described in Example 2 and the following results were obtained.

TABLE III

| Effect of Permanent Solvent on Developer pH Sensitivity | |
|---|---|
| Coupler Solvent | Change in Gamma per pH Unit |
| Tricresylphosphate (Prior Art) | 1.15 |
| Oleyl alcohol | 0.74 |
| Oleyl alcohol (Present Invention) | 0.61 |

The results confirmed the earlier results reported in Example 2. The films containing magenta coupler M-2 dispersed in the permanent solvent of the present invention are considerably less sensitive to changes in the color developer pH.

EXAMPLE 4

Example 2 was repeated except that 20 grams 2.4 ditertiary pentylphenol and 20 grams of oleyl alcohol were employed as the permanent solvent. Comparable results were also obtained. This is the preferred example.

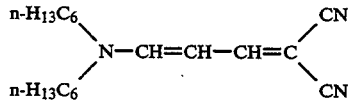

UV-1

-continued
UV-2
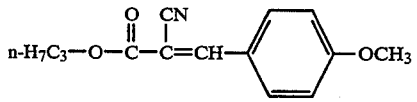
Y-1
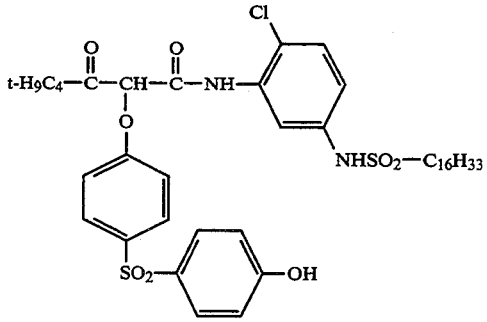
Y-2
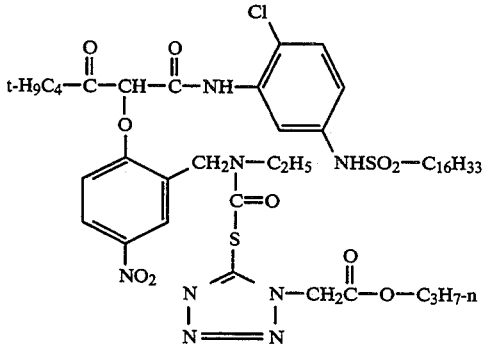
Y-3
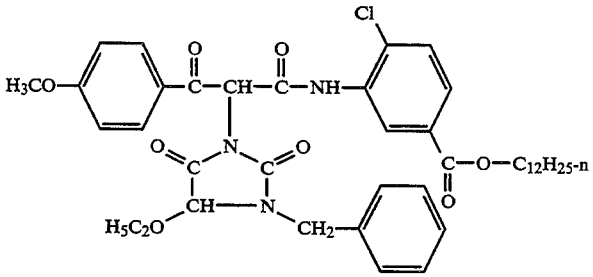
I-1
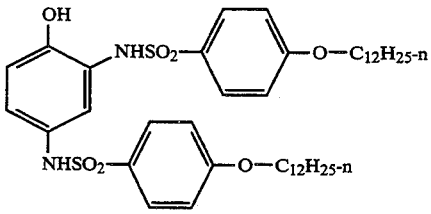
M-86
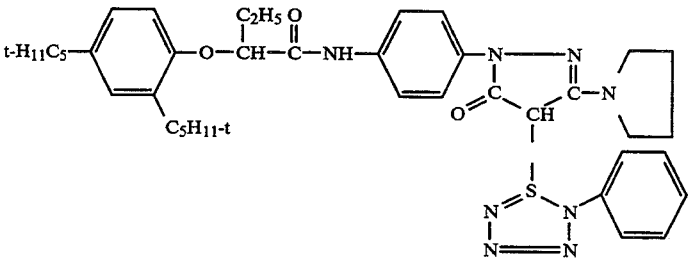

-continued
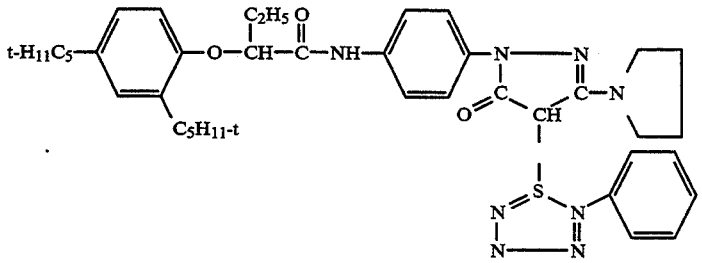
M-87
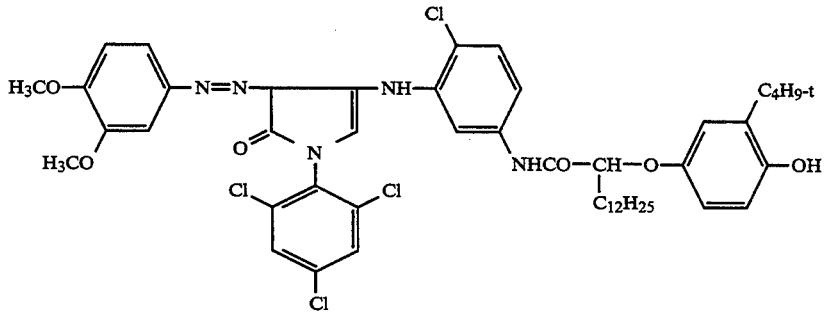
C-1
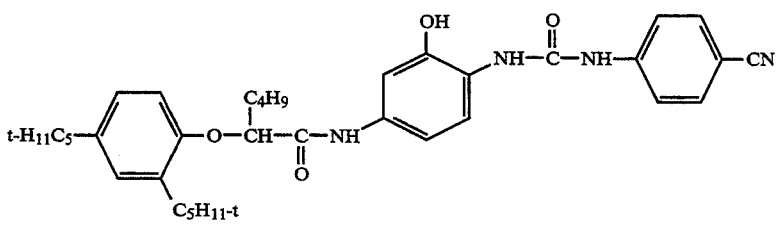
C-2
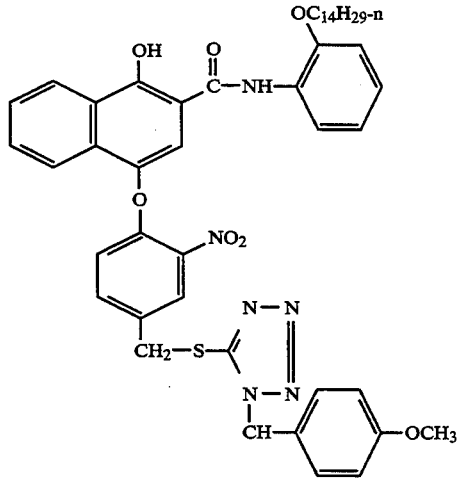

-continued

C-3

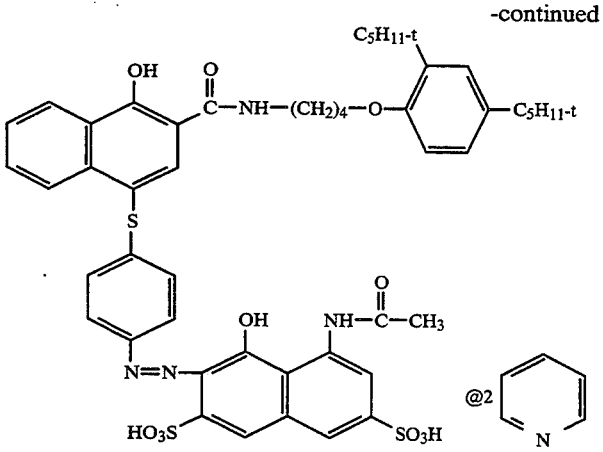

C-4

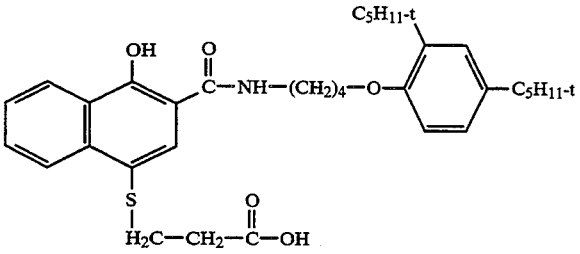

We claim:

1. A silver halide light-sensitive photographic material comprising: a support and provided thereon a plurality of light-sensitive layers including a green-sensitive layer comprising a magenta coupler having the formula:

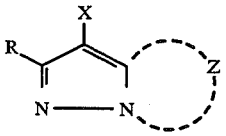

wherein Z represents a group of atoms forming a nitrogen-containing heterocyclic ring; X represents a hydrogen atom or a substituent capable of splitting off by a reaction with an oxidation product of a developer and R represents a hydrogen atom or a substituent; and a coupler solvent having the formula:

R'—OH wherein R' represents an aliphatic hydrocarbyl radical having from 8 to 32 carbon atoms and at least one double-bond linking adjacent aliphatic carbon atoms.

2. The photographic material of claim 1 wherein the coupler solvent is present in the amount of from 0.01 to 10 g/g of magenta coupler.

3. The photographic material of claim 2 wherein the coupler solvent is present in the amount of from 0.1 to 4 g/g of a magenta coupler.

4. The photographic material of claim 1, wherein the substituent represented by R is an alkyl group, an aryl group, an anilino group, an acylamino group, a sulfonamide group, an alkylthio group, an arylthio group, an alkenyl group, a cycloalkyl group, a halogen atom, a cycloalkenyl group, an alkynyl group, a heterocyclic group, a sulfonyl group, a sulfinyl group, a phosphonyl group, an acyl group, a carbamoyl group, a sulfamoyl group, a cyano group, an alkoxy group, an aryloxy group, a heterocyclicoxy group, a siloxy group, an acyloxy group, a carbamoyloxy group, an amino group, an alkylamino group, an imido group, a ureido group, a sulfamoylamino group, an alkoxycarbonylamino group, an aryloxycarbonylamino group, an alkoxycarbonyl group, an aryloxycarbonyl group, a heterocyclicthio group, a spiro compound residue, or a bridged hydrocarbon residue.

5. The photographic material of claim 1, wherein the group represented by X is an alkoxy group, an aryloxy group, a heterocyclicoxy group, an acyloxy group, a sulfonyloxy group, an alkoxycarbonyloxy group, an aryloxycarbonyloxy group, an alkyloxalyloxy group, an alkoxyoxalyloxy group, an alkylthio group, an arylthio group, a heterocyclicthio group, an alkoxythiocarbonylthio group, an acylamino group, a sulfonamide group, a nitrogen-containing heterocyclic group having a bonding site at the nitrogen atom, an alkoxycarbonylamino group, an aryloxycarbonylamino group, a carboxyl group, and

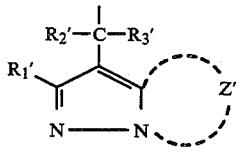

wherein $R_1'$ is the same as those defined for R and Z, is pyrazole ring, an imidazole ring, a triazole ring or a tetrazole ring; and $R_2'$ and $R_3'$ represent independently a hydrogen atom, an alkyl group, an aryl group and a heterocyclic group, 6. The photographic material of claim 1, wherein the nitrogen-containing heterocyclic ring formed by Z is a pyrazole ring, an imidazole ring, a triazole ring or a tetrazole ring.

7. The photographic material of claim 1, wherein the magenta coupler is represented by one of:

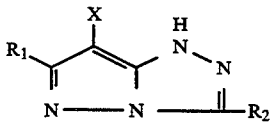

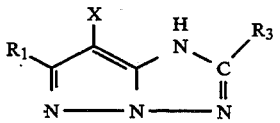

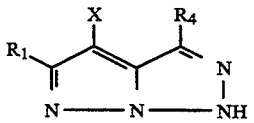

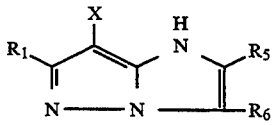

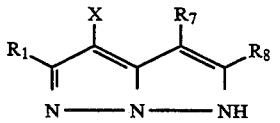

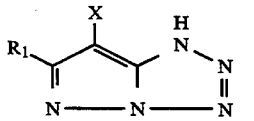

wherein $R_1$ to $R_8$ are independently selected from an alkyl group, an aryl group, an anilino group, an acylamino group, a sulfonamide group, an alkylthio group, an arylthio group, an alkenyl group, a cycloalkyl group, a halogen atom, a cycloalkenyl group, an alkynyl group, a heterocyclic group, a sulfonyl group, a sulfinyl group, a phosphonyl group, an acyl group, a carbamoyl group, a sulfamoyl group, a cyano group, an alkoxy group, an aryloxy group, a heterocyclicoxy group, a siloxy group, an acyloxy group, a carbamoyloxy group, an amino group, an alkylamino group, an imido group, an ureido group, a sulfamoylamino group, an alkoxycarbonylamino group, an aryloxycarbonylamino group, an alkoxycarbonyl group, an aryloxycarbonyl group, a heterocyclicthio group, a spiro compound residue and a bridged hydrocarbon residue and X is independently selected from an alkoxy group, an aryloxy group, a heterocyclicoxy group, an acyloxy group, asulfonyloxy group, an alkoxycarbonyloxy group, an aryloxycarbonyloxy group, an alkyloxalyloxy group, an alkoxyaxalyoxy group, an alkylthio group, an arylthio group, a heterocyclicthio group, an alkoxythiocarbonylthio group, an acylamino group, a sulfonamide group, a nitrogen-containing heterocycle having a bonding site at the nitrogen atom, an alkoxycarbonylamino group, an aryloxycarbonylamino group, a carboxyl group, and

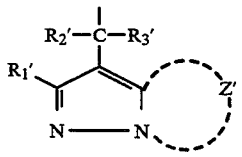

wherein $R_1'$ is the same as R and Z' is a pyrazole ring or a tetrazole ring; and $R_2'$ and $R_3'$ represent a hydrogen atom, an aryl group, an alkyl group and a heterocyclic group.

8. The photographic material of claim 7, wherein the magenta coupler is represented by

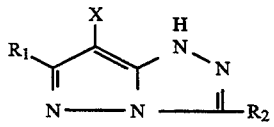

wherein $R_1$ and $R_2$ each independently represent a hydrogen atom or a substituent.

9. The silver halide light-sensitive photographic material of claim 1, wherein said magenta coupler is a pyrazolazole dye forming coupler.

10. The silver halide light sensitive photographic element of claim 9 wherein the coupler is a pyrazolotriazole image dye forming coupler.

11. The silver halide light-sensitive photographic element of claim 10 wherein the coupler is a 1 H-pyrazolo 3,2-C-1,2,4-triazole coupler.

12. The silver halide light-sensitive photographic element of claim 9 wherein $R^1$—OH is oleyl alcohol.

13. The silver halide light-sensitive photographic element of claim 9 wherein the coupler solvent also includes a second coupler solvent.

14. The silver halide light-sensitive photographic element of claim 13 wherein the second coupler solvent is 2,4-ditertiary pentyl phenol.

15. The silver halide light-sensitive photographic element of claim 13 wherein the second coupler solved is tricresylphosphate.

* * * * *